US008393857B2

(12) United States Patent
Copeland et al.

(10) Patent No.: US 8,393,857 B2
(45) Date of Patent: Mar. 12, 2013

(54) VARIABLE VANE ACTUATION SYSTEM

(75) Inventors: Andy Copeland, Greenwood, IN (US); Linnea Ohlsson, Indianapolis, IN (US); Ted Freeman, Avon, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1034 days.

(21) Appl. No.: 12/576,810

(22) Filed: Oct. 9, 2009

(65) Prior Publication Data

US 2011/0085885 A1 Apr. 14, 2011

(51) Int. Cl.
*F01D 17/16* (2006.01)

(52) U.S. Cl. ..... 415/160

(58) Field of Classification Search ..... 415/151, 415/159, 160, 162

See application file for complete search history.

(56) References Cited

U.S. PATENT DOCUMENTS

| | | | | |
|---|---|---|---|---|
| 2,858,062 | A | | 10/1958 | Allen |
| 2,933,234 | A | | 4/1960 | Neumann |
| 2,933,235 | A | | 4/1960 | Neumann |
| 3,487,992 | A | | 1/1970 | Pineda |
| 3,779,665 | A | | 12/1973 | Taten, Jr. et al. |
| 3,873,230 | A | | 3/1975 | Norris et al. |
| 4,049,360 | A | | 9/1977 | Snell |
| 4,295,784 | A | | 10/1981 | Manning |
| 4,409,788 | A | | 10/1983 | Nash et al. |
| 4,492,520 | A | | 1/1985 | Marchand |
| 4,652,208 | A | * | 3/1987 | Tameo ..... 415/162 |
| 4,679,984 | A | | 7/1987 | Swihart et al. |
| 4,720,237 | A | | 1/1988 | Weiner et al. |
| 4,755,104 | A | | 7/1988 | Castro et al. |
| 4,812,106 | A | | 3/1989 | Purgavie |
| 4,867,635 | A | | 9/1989 | Tubbs |
| 4,890,977 | A | | 1/1990 | Tremaine et al. |
| 5,024,580 | A | | 6/1991 | Olive |
| 5,228,828 | A | | 7/1993 | Damlis et al. |
| 5,549,448 | A | | 8/1996 | Langston |
| 6,174,130 | B1 | | 1/2001 | King et al. |
| 6,551,057 | B1 | | 4/2003 | Haaser et al. |
| 6,769,868 | B2 | | 8/2004 | Harrold |
| 6,821,084 | B2 | | 11/2004 | Bathori et al. |
| 6,948,910 | B2 | | 9/2005 | Polacsek |
| 7,114,919 | B2 | | 10/2006 | Scholz et al. |
| 7,182,571 | B2 | | 2/2007 | Selby |
| 7,223,066 | B2 | | 5/2007 | Rockley |
| 7,278,819 | B2 | | 10/2007 | Schilling |

* cited by examiner

*Primary Examiner* — Richard Edgar
(74) *Attorney, Agent, or Firm* — Krieg DeVault LLP

(57) ABSTRACT

A variable vane actuation system is disclosed herein. The variable vane actuation system includes a first vane having a first vane axis. The variable vane actuation system also includes an actuator operably engaged with the first vane to selectively pivot the first vane about the first vane axis. The variable vane actuation system also includes a ring member operably connected with the first vane. The ring member is disposed for pivoting movement about a centerline axis transverse to the first vane axis. The variable vane actuation system also includes a second vane having a second vane axis spaced from the first vane axis about the centerline axis. The second vane is operably connected with the ring member. Forces moving the second vane are generated by the actuator and transmitted first through the first vane and then through the ring member before being applied to the second vane.

20 Claims, 3 Drawing Sheets

VARIABLE VANE ACTUATION SYSTEM

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of FA8650-07-6-2803 awarded by the Department of Defense.

BACKGROUND OF THE INVENTION

1. Field of the Invention

The invention relates to a system for moving variable stator vanes, such as in a turbine engine for example.

2. Description of Related Prior Art

Variable pitch stator vanes can be used in gas turbine engines. These vanes can be pivotally mounted inside a case and can be arranged in a circumferential row positioned along a centerline axis of the turbine engine. Generally, each of the individual vanes can pivot on a spindle about an axis that extends transverse to the centerline axis. Engine performance and reliability can be enhanced by varying the angle of the vanes at different stages during the operation of the turbine engine.

SUMMARY OF THE INVENTION

In summary, the invention is a variable vane actuation system. The variable vane actuation system includes a first vane having a first vane axis. The variable vane actuation system also includes an actuator operably engaged with the first vane to selectively pivot the first vane about the first vane axis. The variable vane actuation system also includes a ring member operably connected with the first vane. The ring member is disposed for pivoting movement about a centerline axis that is transverse to the first vane axis. The variable vane actuation system also includes a second vane having a second vane axis spaced from the first vane axis about the centerline axis. The second vane is operably connected with the ring member. Forces moving the second vane are generated by the actuator and transmitted first through the first vane and then through the ring member before being applied to the second vane.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF AN EXEMPLARY EMBODIMENT

The invention, as exemplified in the embodiment described below, can be applied to improve systems applied to pivot a plurality of vanes. In the exemplary embodiment, one of the blades is directly driven in pivoting movement by an actuator and this blade, in turn, directs movement of a ring member operably coupled to other vanes. Thus, several vanes arranged about an axis can be driven by one vane. Embodiments of the invention can be practiced in operating environments in which the actuator cannot fit near the position at which the ring must be located. In such operating environments, the actuator must be connected to the ring through additional linkages which can become complicated and add additional tolerance issues and/or weight to the system. The embodiment disclosed below also allows the actuator to be placed in an area that may be cooler than the area near the ring.

Figure 1:
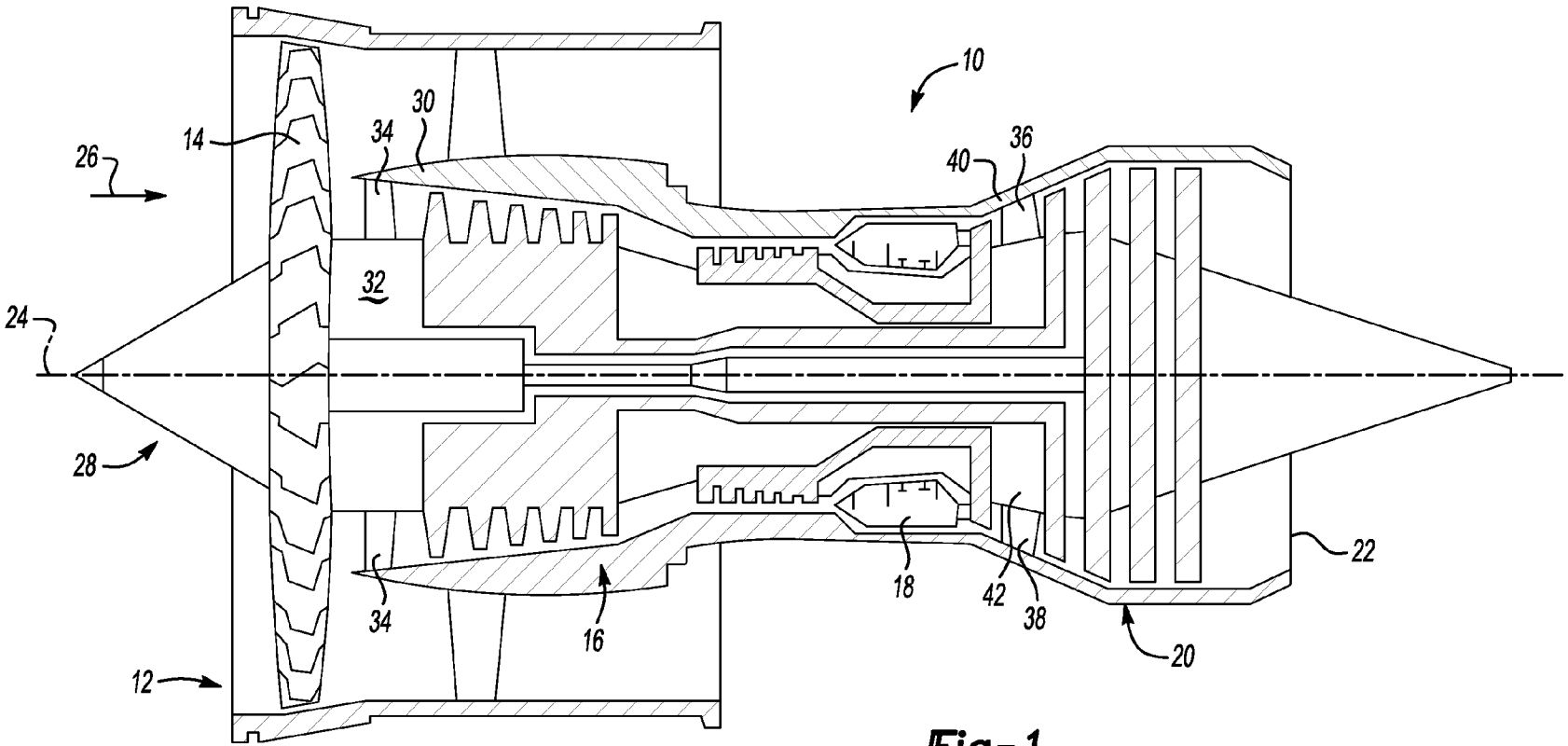
FIG. 1 is a schematic view of a turbine engine which incorporates an exemplary embodiment of the invention.

Referring to FIG. 1, a turbine engine 10 can include an inlet 12 and a fan 14. The exemplary fan 14 can be a bladed disk assembly having a disk or hub defining a plurality of slots and a plurality of fan blades, each fan blade received in one of the slots. In alternative embodiments of the invention, the fan can be a blisk wherein the hub and blades are integrally formed and unitary. The turbine engine can also include a compressor section 16, a combustor section 18, and a turbine section 20. The turbine engine 10 can also include an exhaust section 22. The fan 14, compressor section 16, and turbine section 20 include components arranged to rotate about a centerline axis 24. Fluid such as air can be drawn into the turbine engine 10 as indicated by the arrow referenced at 26. The fan 14 directs fluid to the compressor section 16 where it is compressed. A portion of the fluid can be diverted radially outside of the compressor section 16 and thereby become bypass flow. The compressed fluid emerging from the compressor section 16 is mixed with fuel and ignited in the combustor section 18. Combustion gases exit the combustor section 18 and flow through the turbine section 20. Energy is extracted from the combustion gases in the turbine section 20.

A nose cone assembly 28 can be attached to the fan 14. A turbine case 30 can encircle the core engine components (the compressor, combustor and turbine sections 16, 18, 20). The turbine case 30 can be fixed to a non-rotating hub 32 through a plurality of struts 34. Downstream of the combustor section 18, a row of turbine vanes, such as vanes 36, 38 can be positioned to direct the flow of combustion gases to the turbine section 20. The vanes 36, 38 can extend radially relative to the centerline axis 24, between an outer case 40 and an inner case 42. The outer case 40 can be integral with or separately formed from the case 30.

Figure 2:
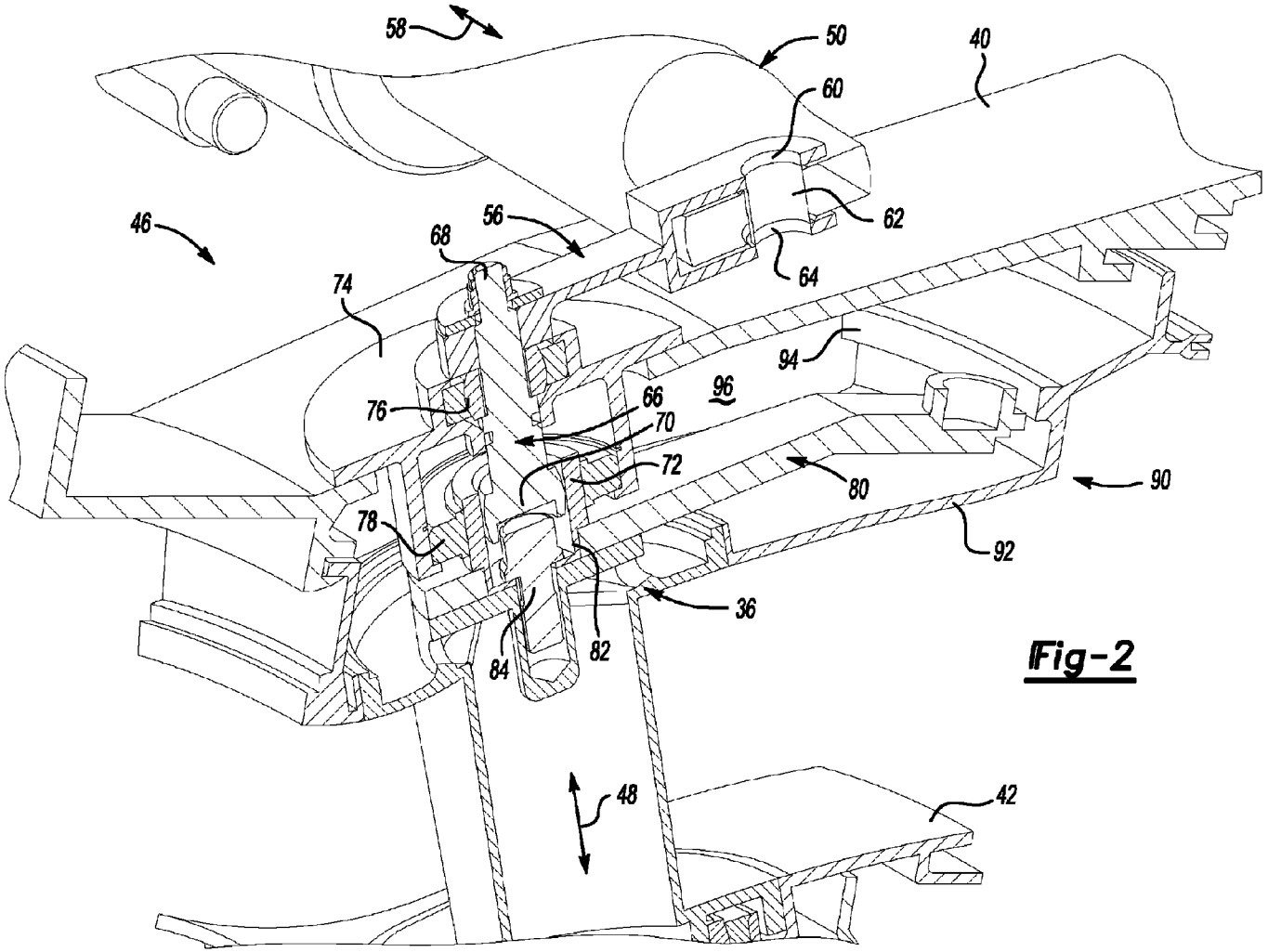
FIG. 2 is a detailed perspective section of the turbine engine shown schematically in FIG. 1, in which the section is taken through a drive vane of the exemplary embodiment of the invention.
Figure 3:
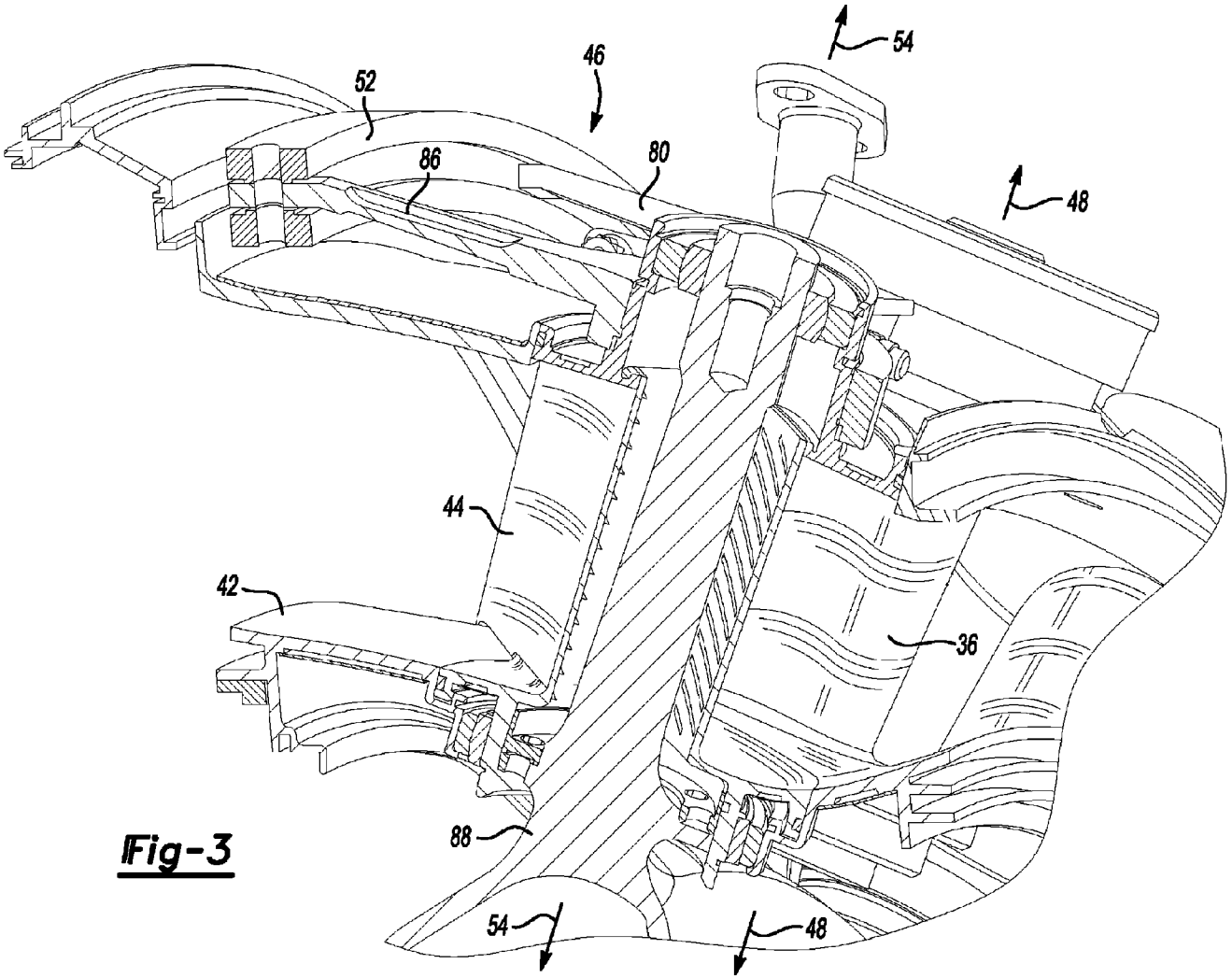
FIG. 3 is a detailed perspective section of the turbine engine shown schematically in FIG. 1, in which the section is taken through a driven vane of the exemplary embodiment of the invention.

FIG. 2 is a first perspective view of a detailed section of the turbine engine 10 shown schematically in FIG. 1. The first section is taken generally in plane containing the centerline axis 24 shown in FIG. 1. FIG. 3 is a second perspective view of a detailed section of the turbine engine 10 shown schematically in FIG. 1. The second section is taken generally in plane containing the centerline axis 24 shown in FIG. 1. The section shown in FIG. 2 is taken through a drive vane 36 (as will be described in greater detail below). The section shown in FIG. 3 is taken through a driven vane 44 (as will be described in greater detail below). The drive vane 36 and the driven vane 44 are spaced from one another about the centerline axis 24 (shown in FIG. 1). In the exemplary embodiment, the drive vane 36 and the driven vane 44 are circumferentially adjacent to one another about the centerline axis 24. It is noted that the views of FIGS. 2 and 3 are taken from opposite circumferential directions. For example, the view of FIG. 2 can be considered as being counter-clockwise relative the centerline axis 24. The left of FIG. 2 is forward and the right of FIG. 2 is aft relative to the turbine engine 10 shown in FIG. 1. The view of FIG. 3 can be considered as being clockwise relative the centerline axis 24. The left of FIG. 3 is aft and the right of FIG. 3 is forward relative to the turbine engine 10 shown in FIG. 1.

A variable vane actuation system 46 is provided to move the turbine vanes, including the vanes 36 and 44. The variable vane actuation system 46 includes a first vane. In the exemplary embodiment the first vane is the drive vane 36. The drive vane 36 has a drive vane axis 48. The drive vane axis 48 can be the central axis of the drive vane 36 or can be offset from the central axis of the drive vane 36. The drive vane axis 48 can be transverse to the centerline axis 24 shown in FIG. 1. In the exemplary embodiment, the drive vane axis 48 is not normal to the engine axis 24. The drive vane axis 48 can intersect and be normal to the centerline axis 24 in other embodiments of the invention. The orientation of the drive vane axis 48 relative to the axis 24 can be selected in view of the designs of other components in the system.

The variable vane actuation system 46 also includes an actuator 50. The actuator 50 is operably engaged with the drive vane 36 to selectively pivot the drive vane 36 about the drive vane axis 48. The actuator 50 can take any form. For example, the actuator 50 can be an electronic screw mechanism, a hydraulic cylinder, or any other mechanism capable of generating a moving force. The actuator 50 can be positioned radially outside of the outer case 40.

The variable vane actuation system 46 also includes a ring member 52. The ring member 52 is shown in FIG. 3, but has been removed from FIG. 2 so that other structures of the exemplary embodiment are more clearly visible. The ring member 52 is positioned radially between the outer case 40 and the inner case 42. The case 40 thus isolates the actuator 50 from the ring member 52. In addition, the actuator 50 can be spaced any distance from the ring member 52 in various embodiments of the invention. The ring member 52 is operably connected with the drive vane 36 such that the ring member 52 moves in response to movement of the drive vane 36. The ring member 52 is disposed for pivoting movement about the centerline axis 24 shown in FIG. 1.

As best seen in FIG. 3, the variable vane actuation system 46 also includes a second vane. In the exemplary embodiment the second vane is the driven vane 44. The driven vane 44 includes a driven vane axis 54 spaced from the drive vane axis 48 about the centerline axis 24 shown in FIG. 1. The driven vane axis 54 can be the central axis of the driven vane 44 or can be offset from the central axis of the driven vane 44. The driven vane axis 54 can be transverse to the centerline axis 24 shown in FIG. 1. In the exemplary embodiment, the driven vane axis 54 can intersect and be normal to the centerline axis 24.

The driven vane 44 is operably connected with the ring member 52 such that the driven vane 44 moves in response to movement of the ring member 52. The driven vane 44 can pivot about the driven vane axis 54 in response to movement of the ring member 52. Forces moving the driven vane 44 are generated by the actuator 50 and transmitted first through the drive vane 36 and then through the ring member 52 before being applied to the driven vane 44. The drive vane 36 is thus a mechanical link between the ring member 52 and the actuator 50 and also between the actuator 50 and the second or driven link 44.

FIG. 2 shows a connection between the actuator 50 and the drive vane 36 in the exemplary embodiment. A first arm 56 can pivotally couple the drive vane 36 and the actuator 50 such that movement of the actuator 50 results in pivoting of the drive vane 36 about the drive vane axis 48. The actuator 50 can be a telescoping structure such that the portion of the actuator 50 connected to the first arm 56 moves along a linear path represented by arrow 58. The actuator 50 and the first arm 56 can be connected through a pin (not shown) extending through aligned apertures 60, 62, 64 in the first arm 56 and the actuator 50. In alternative embodiments, the actuator 50 can be directly connected to the drive vane 36.

It is noted that the drive vane 36 and/or the driven vane 44 can be an integral or unitary structure, or can be formed from multiple structures that are fixed together for rotation. In the exemplary embodiment, the first arm 56 is coupled to a torque shaft 66 extending substantially along the drive vane axis 48. The torque shaft 66 can extend between a first end 68 proximate to the first arm 56 and a second end 70 spaced from the first end 68. In the exemplary embodiment, the second end 70 can include spherical splines and be received in a mating socket 72 having straight splines. The spherical connection between the torque shaft 66 and the socket 72 allows the torque shaft 66 to be oblique to the drive vane axis 48 if desired. The socket 72 can be fixed to the drive vane 36 for concurrent rotation. At least part of the torque shaft 66 and the socket 72 can be contained in a housing 74 in the exemplary embodiment. A bearing 76 and a bushing 78 can be positioned in the housing 74 and support the torque shaft 66 and the socket 72 for rotation. The housing 74 can be mounted in the outer case 40.

A second arm 80 can pivotally couple the drive vane 36 and the ring member 52 such that movement of the drive vane 36 about the drive vane axis 48 results in pivoting of the ring member 52 (shown in FIG. 3) about the centerline axis 24 (shown in FIG. 1). The first arm 56 and second arm 80 can be spaced radially from one another along the drive vane axis 48 relative to the centerline axis 24. The first arm 56 and the second arm 80 can also be positioned on opposite radial sides of the outer case 40. In the exemplary embodiment, the second arm 80 can be positioned outside of the housing 74 and encircle a lower portion 82 of the socket 72 and a hub 84 of the drive vane 36. The outer surfaces of the lower portion 82 and of the hub 84 can have splines that engage splines defined by the second arm 80 whereby the torque shaft 66, the socket 72, the drive vane 36, and the second arm 80 are fixed together for rotation.

Referring now to FIG. 3, the ring member 52 can be driven in pivoting movement and cause a third arm 86 to move. The third arm 86 can be pivotally coupled the ring member 52 such that movement of the ring member 52 about the centerline axis 24 results in pivoting of the third arm 86 about the driven vane axis 54. The third arm 86 can be fixed to the driven vane 44 for concurrent rotation.

The case 40 is an outer support member at least partially encircling the centerline axis 24 shown in FIG. 1. The case 40 can support radially outer ends of the vanes 36 and 44 in movement. The case 42 is an inner support member at least partially encircling the centerline axis 24 shown in FIG. 1. The case 42 can support radially inner ends of the vanes 36 and 44 in movement. It is noted that the outer case 40 has been removed from FIG. 3 to allow other structures to be shown more clearly. The drive vane 36 and the driven vane 44 can be part of a row of vanes circumferentially spaced from one another about the centerline axis 24. The row can include more vanes than the vanes 36 and 44. The ring member 52 can be coupled to one-half of the vanes of the row, such as the vanes disposed substantially 180° about the centerline axis 24.

Embodiments of the invention can include more than one variable vane actuation system 46, each with a drive vane such as drive vane 36. The plurality of systems 46 can be arranged such that the drive vanes are spaced 180° from each other, circumferentially about the axis 24. However, the plurality of systems 46 can also be arranged such that the drive vanes are spaced differently than 180° from each other. In the exemplary embodiment of the invention, the drive vanes can be spaced 160° from each other. In such an embodiment, one drive vane can be engaged with and drive more driven vanes than the drive vane of another system.

In the exemplary embodiment, the driven vane 44 can encircle and rotate about a non-rotating strut 88. The strut 88 extends between the outer case 40 and the inner case 42. The drive vane 36 is spaced from the strut 88 about the centerline axis 24. All or less than all of the vanes driven in pivoting movement through the drive vane 36 can be mounted on struts.

Referring again primarily to FIG. 2, an annular channel member 90 can be disposed between the outer case 40 and the inner case 42. The channel member 90 can be fully annular and extend 360° about the centerline axis 24 or can be partially annular and extend less than 360° about the centerline axis 24. The channel member 90 includes a substantially closed bottom 92 and an open top 94 spaced radially outward from the substantially closed bottom 92. The channel member 90 can be coupled with the outer case 40 to form a chamber 96. The ring member 52 can be positioned in the chamber 96. The first arm 56 can be positioned outside the chamber 96 and the second arm 80 can be positioned inside the chamber 96.

A first fluid flow path can be defined between the outer case 40 and the inner case 42. The fluid flowing along the first flow path can be core engine flow. In the exemplary embodiment, core engine flow can be contained between the case 42 and the channel member 90. The case 40 can be the turbine case and act as a pressure vessel. Air can pass between the channel member 90 and the case 40 for cooling. This air can be introduced into the core stream through the vane 36 and/or by leakage. Thus, core flow can be any flow that starts as core flow or becomes core flow downstream of the engine inlet 12.

The ring member 52 can be isolated from the first fluid flow path by the channel member 90. In addition, a second fluid flow path can be defined outside the outer case 40. This flow can be bypass flow. The exemplary ring member 52 is positioned between both the first and second flows of fluid and is also isolated from both flows. Thus, the ring member 52 and the arms 80, 86 linked to the ring member 52 do not interfere with the core engine flow or with the bypass flow.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. The right to claim elements and/or sub-combinations of the combinations disclosed herein is hereby reserved.

What is claimed is:

1. A variable vane actuation system comprising:

a first vane having a first vane axis;

an actuator operably engaged with said first vane to selectively pivot said first vane about said first vane axis;

a ring member operably connected with said first vane and disposed for pivoting movement about a centerline axis transverse to said first vane axis; and a second vane having a second vane axis spaced from said first vane axis about said centerline axis and operably connected with said ring member, wherein forces moving said second vane are generated by said actuator and transmitted first through said first vane and then through said ring member before being applied to said second vane.

2. The variable vane actuation system of claim 1 further comprising:

a first arm pivotally coupling said first vane and said actuator; and a second arm pivotally coupling said first vane and said ring member, wherein said first arm and second arm are spaced radially from one another along said first vane axis relative to said centerline axis.

3. The variable vane actuation system of claim 1 further comprising:

a case isolating said actuator from said ring member.

4. The variable vane actuation system of claim 3 further comprising:

an annular channel member having a substantially closed bottom and an open top spaced radially outward from said substantially closed bottom, said annular channel member coupled with said case to form a chamber, wherein said ring member is positioned in said chamber.

5. The variable vane actuation system of claim 4 further comprising:

a first arm pivotally coupling said first vane and said actuator and positioned outside said chamber; and a second arm pivotally coupling said first vane and said ring member and positioned inside said chamber.

6. The variable vane actuation system of claim 1 further comprising:

a non-rotating strut extending through said second vane.

7. The variable vane actuation system of claim 1 further comprising:

an outer support member at least partially encircling said centerline axis;

an inner support member at least partially encircling said centerline axis and spaced radially inward from said outer annular support member relative to said centerline axis; and at least one strut extending between said outer annular support member and said inner annular support member, wherein said first vane is spaced from said at least one strut about said centerline axis and wherein said second vane encircles said at least one strut.

8. The variable vane actuation system of claim 7 wherein a fluid flow path is defined between said outer annular support member and said inner annular support member, wherein said ring member is isolated from said fluid flow path.

9. The variable vane actuation system of claim 8 further comprising:

an annular channel member having an open top facing radially outward and cooperating with said outer annular support member to enclose said ring member.

10. A method for pivoting a plurality of vanes comprising the steps of:

connecting a plurality of vanes for concurrent pivoting movement with a ring member;

moving a ring member with an actuator; and operably positioning one of the plurality of vanes as a mechanical link between the ring member and the actuator.

11. The method of claim 10 further comprising the steps of:

enclosing the ring member in a case; and positioning the actuator outside the case.

12. The method of claim 11 further comprising the steps of:

directing a first flow of fluid across the plurality of vanes;

directing a second flow of fluid outside the case; and positioning the ring member between the first and second flows of fluid.

13. The method of claim 12 wherein said positioning step includes the step of:

isolating the ring member from both of the first and second flows of fluid.

14. The method of claim 10 further comprising the step of:

mounting less than all of the plurality of vanes to encircle and rotate about individual, fixed struts.

15. A turbine engine comprising:

a first case at least partially encircling a centerline axis;

a second case at least partially encircling said centerline axis and positioned radially inward of said first case;

a first vane extending between said first case and said second case and operable to pivot about a first vane axis;

an actuator operably engaged with said first vane to selectively pivot said first vane about said first vane axis;

a ring member operably connected with said first vane and disposed for pivoting movement about said centerline axis transverse to said first vane axis; and a second vane extending between said first case and said second case and operable to pivot about a second vane axis spaced from said first vane axis about said centerline axis and operably connected with said ring member, wherein forces moving said second vane are generated by said actuator and transmitted first through said first vane and then through said ring member before being applied to said second vane.

16. The turbine engine of claim 15 wherein said ring member is positioned radially between said first case and said second case.

17. The turbine engine of claim 16 wherein said actuator is positioned radially outside of said first case.

18. The turbine engine of claim 15 further comprising:

a first arm pivotally coupling said first vane and said actuator; and a second arm pivotally coupling said first vane and said ring member, wherein said first arm and said second arm are positioned on opposite radial sides of said first case.

19. The turbine engine of claim 15 further comprising:

a torque shaft extending substantially along said first vane axis between said first arm and said second arm and having at least one end with spherical splines.

20. The turbine engine of claim 15 wherein said first vane and said second vane are further defined as part of a row of vanes fully encircling said centerline axis and wherein said ring member is coupled to one-half of said vanes of said row.

* * * * *